US007722149B2

(12) United States Patent
Suzuki

(10) Patent No.: US 7,722,149 B2
(45) Date of Patent: May 25, 2010

(54) PRINTER AND PRINT CONTROL APPARATUS AND METHOD THEREOF, AND PRINTER DRIVER

(75) Inventor: Takayuki Suzuki, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 251 days.

(21) Appl. No.: 11/480,905

(22) Filed: Jul. 6, 2006

(65) Prior Publication Data

US 2007/0008369 A1 Jan. 11, 2007

(30) Foreign Application Priority Data

Jul. 8, 2005 (JP) ..... 2005-200649

(51) Int. Cl.
*B41J 29/393* (2006.01)

(52) U.S. Cl. ..... 347/19; 347/14; 347/5

(58) Field of Classification Search ..... 347/2, 347/5, 9, 10, 19, 85, 12, 14; 358/1.9
See application file for complete search history.

(56) References Cited

U.S. PATENT DOCUMENTS

| | | | | |
|---|---|---|---|---|
| 6,325,479 | B1 * | 12/2001 | Nakamura et al. | 347/19 |
| 6,726,302 | B2 | 4/2004 | Yamada | |
| 6,804,025 | B1 | 10/2004 | Nishihara et al. | |
| 7,198,347 | B2 | 4/2007 | Tayuki | |
| 7,258,429 | B2 | 8/2007 | Takahashi et al. | |
| 7,517,038 | B2 | 4/2009 | Otsuki | 347/14 |
| 2002/0149785 | A1 * | 10/2002 | Chu et al. | 358/1.9 |
| 2004/0223025 | A1 * | 11/2004 | D'souza et al. | 347/19 |

FOREIGN PATENT DOCUMENTS

| | | |
|---|---|---|
| JP | 2000-043382 | 2/2000 |
| JP | 2000-287085 | 10/2000 |
| JP | 2001-334655 | 12/2001 |
| JP | 2003-196066 | 7/2003 |
| JP | 2004-102445 | 4/2004 |
| JP | 2004-122643 A | 4/2004 |
| JP | 2004-358663 | 12/2004 |
| JP | 2005-007834 A | 1/2005 |
| JP | 2005-081622 | 3/2005 |

OTHER PUBLICATIONS

Japanese Office Action in Application No. 2005-200649 (Aug. 21, 2009).

* cited by examiner

*Primary Examiner*—Lam S Nguyen
(74) *Attorney, Agent, or Firm*—Fitzpatrick, Cella, Harper & Scinto

(57) ABSTRACT

A mounting status of an ink-jet cartridge mounted on a printer is obtained and test data according to the mounting status of the ink-jet cartridge is generated. The test data is used to execute at least either confirmation of printing status using the ink of the ink-jet cartridge or an adjusting operation of printing position. The test data is transmitted to the printer to be printed out.

13 Claims, 18 Drawing Sheets

FIG. 7

HEAD CARTRIDGE SELECTION ☒

UNABLE TO ACQUIRE PRINTER INFORMATION.
SELECT HEAD CARTRIDGE MOUNTED ON THE PRINTER.

HEAD CARTRIDGE : ⦿ COLOR ONLY
○ BLACK ONLY
○ BOTH

OK CANCEL

PRINTER AND PRINT CONTROL APPARATUS AND METHOD THEREOF, AND PRINTER DRIVER

BACKGROUND OF THE INVENTION

1. Field of the Invention

The present invention relates to a printer, a printer driver and a print control apparatus and method for its use in controlling printing by a printer having a replaceable ink-jet cartridge used for printing.

2. Description of the Related Art

Use of a UI screen of a printer driver to perform confirmation of the status of an inkjet printhead mounted on a printer or to perform printhead position adjustment is well known. In a printer provided with such functions, test pattern data to be used for confirmation of inkjet printhead status or adjustment of printhead position is stored in the printer, and the printer prints a test pattern for such checks in response to commands transmitted from a printer driver.

In this regard, with the goal of reducing the amount of memory required on printing, a technique involving preparation of such test pattern data on the print control (PC) apparatus-side is disclosed in Japanese Patent Laid-Open No. 2004-102445. According to the technique, the print control apparatus transmits the given test pattern data to the printer upon being instructed to confirm the status of the printer's inkjet printhead, causing the printer to print the test pattern.

However, the technique described in the above patent document does not take into consideration printers which allow variable inkjet printhead configurations, or in other words, printers which allow ink-jet cartridges for color ink and an ink-jet cartridge for black ink to be individually or simultaneously mounted. Therefore, the technique allows only fixed test pattern data to be transmitted to a printer at any time, regardless of the type and mounting status of ink-jet cartridges.

SUMMARY OF THE INVENTION

The object of the present invention is to solve the problem seen in the conventional technique described above.

The feature of the present invention is to provide a print control apparatus and a method for its use, allowing a printer to print a test pattern according to the type of ink-jet cartridges which are mounted on the printer, thereby allowing creation of a printer and printer driver which are at least capable of performing either of confirmation of printing status or printhead position adjustment using the ink contained in the ink-jet cartridges.

According to the present invention, there is provided with a print control apparatus for supplying a signal to a printer and controlling the printer, comprising:

obtaining means for obtaining information indicating a mounting status of an ink-jet cartridge that ejects ink on a printer;

data generation means for generating test data for causing the printer to print a test pattern corresponding to the mounting status of the ink-jet cartridge, based on the information obtained by said obtaining means; and transmission means for transmitting the test data generated by said data generation means to the printer.

Further, according to the present invention, there is provided with a print control method of supplying a signal to a printer and controlling the printer, comprising:

an obtaining step of obtaining information indicating a mounting status of an ink-jet cartridge that ejects ink on a printer;

a data generation step of generating test data for causing the printer to print a test pattern corresponding to the mounting status of the ink-jet cartridge, based on the information obtained in said obtaining step; and a transmission step of transmitting the test data generated in said data generation step to the printer.

The features of the invention are achieved by a combination of the features set forth in the independent claims, while the dependent claims define specific advantageous examples of the invention.

Other features and advantages of the invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 7 depicts a view illustrating an example of a UI screen displayed on a monitor in step S103 of FIG. 6;

DESCRIPTION OF THE EMBODIMENTS preferred embodiment of the present invention will now be described in detail with reference to the accompanying drawings. It should be noted that the embodiments below do not limit the present invention set forth in the claims and that not all of the combinations of features described in the embodiments are necessarily essential as means for attaining the objects of the invention.

Figure 1:
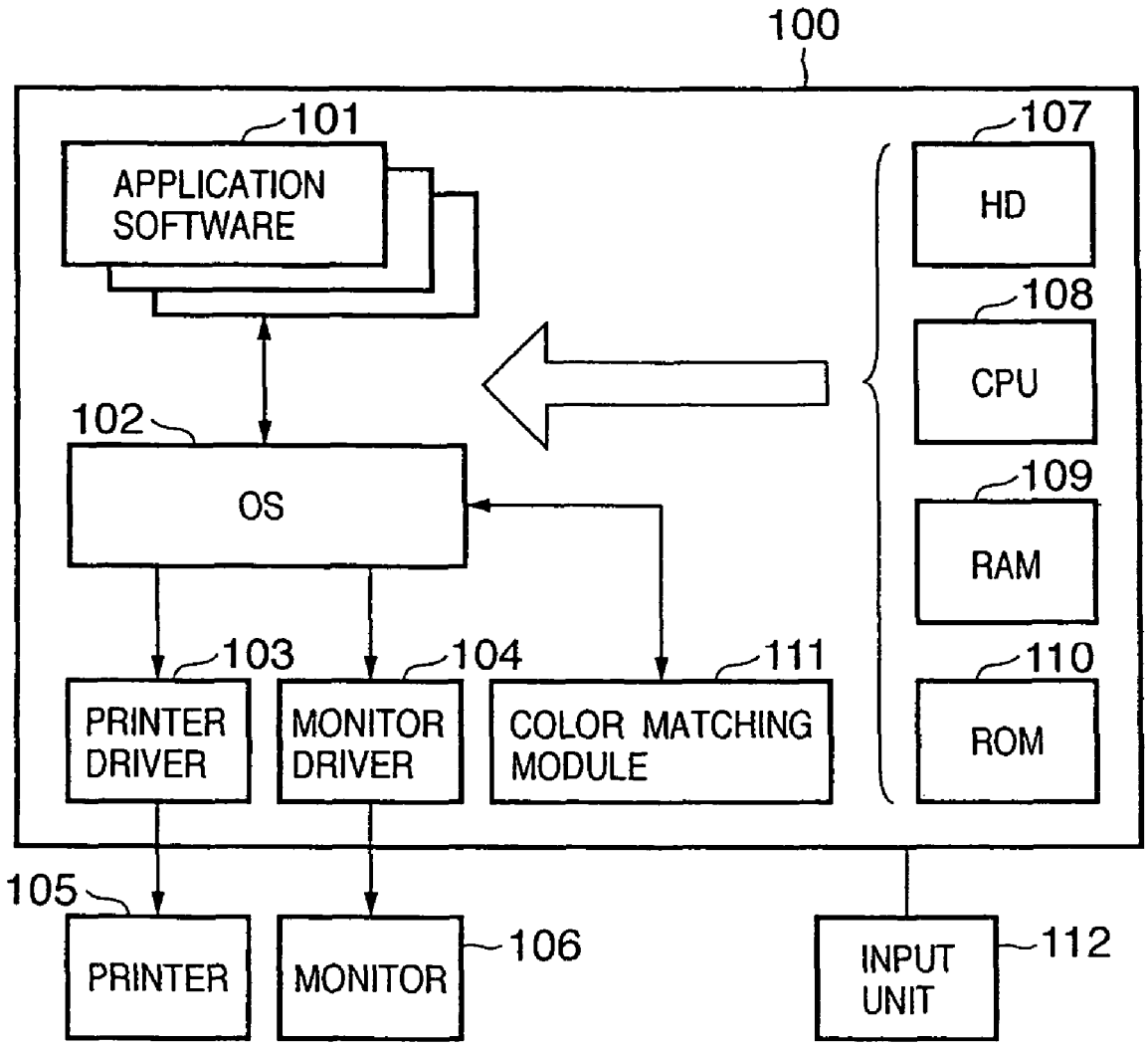
FIG. 1 is a block diagram showing a configuration of a print system according to an embodiment of the present invention.

FIG. 1 is a block diagram showing a configuration of a print system according to an embodiment of the present invention. In this configuration, a host computer 100 and a printer 105 are connected via a USB or a Centronics interface, or a wireless interface and the like, and an image is printed by the printer 105 according to print data supplied from the host computer 100 to the printer 105. The printer 105 is, for instance, a printer which prints an image using the inkjet method. A monitor 106 is a display monitor, which is provided with a liquid crystal, CRT or SED display panel and the like.

The host computer 100 comprises various application software 101 such as a word-processing software, a spreadsheet software or an Internet browser. Various groups of drawing processing instructions (image drawing instructions, text drawing instructions and graphic drawing instructions) which indicate output images issued by the application software 101 are inputted into a monitor driver 104 via an operating system (OS) 102. In addition, when performing printing, the groups of drawing instructions are also inputted to a printer driver 103 via the OS 102. The printer driver 103 processes the groups of drawing instructions to create print data. The printer driver 103 outputs the print data to the printer 105, and makes the printer 105 print the print data. The monitor driver 104 also processes the groups of drawing instructions to create display data, and makes the monitor 106 display images. The various application software 101, the printer driver 103 and the monitor driver 104 are installed in a hard disk (HD) 107, and are loaded onto a RAM 109 either upon activation of the host computer 100 or upon execution of a program, to be executed under the control of a CPU 108.

The RAM 109 also provides a work area for temporarily storing various data upon control and processing performed by the CPU 108. The ROM 110 stores boot programs and the like. An input unit 112 comprises a keyboard and a pointing device such as a mouse, and is used for inputting various data or commands in response to operation by an operator. As for the host computer 100, for instance, a widely-used personal computer (PC) is used, while Windows (R) XP (registered trademark) from Microsoft Corporation is used as the OS 102. The present configuration involves installing an arbitrary application software 101 having print functions, and connecting the monitor 106 and the printer 105 to such a personal computer (PC).

At the host computer 100, image data to be outputted is created by the application software 101 using text data classified as text such as characters, graphic data classified as graphics such as figures, image data classified as images such as photographic images, and the like. When performing printing based on the output image data, the application software 101 issues a print request to the OS 102. At this point, the text data portion, the graphic data portion, and the image data portion are respectively converted into text drawing instructions, graphic drawing instructions and image drawing instructions, and are issued as a print instruction which includes this group of drawing instructions to the OS 102.

When receiving a print request from the application software 101 in this manner, the OS 102 hands over the group of drawing instructions to the print driver 103 corresponding to the connected printer 105. The printer driver 103 processes the print request and the group of drawing instructions handed over from the OS 102, creates print data which can be processed by the printer 105, and outputs the created print data to the printer 105. If the current printer 105 is a raster printer, the printer driver 103 sequentially rasterizes the group of drawing instructions into, for instance, a band memory respectively having depths of 8 bits of R (red), G (green) and B (blue). After rasterizing all of the drawing instructions, the printer driver 103 converts the contents of the page memory into a data format that is printable by the printer 105, such as C (cyan), M (magenta), Y (yellow), K (black) data, and sends the converted data to the printer 105. The band memory is, for instance, allocated to the RAM 109. Color reproducing properties of the printer 105 and the monitor 106 are stored in a color matching module 111, and color conversion is performed based on the stored color reproducing properties so as to correct the differences in the colors of the displayed image and the printed image.

Figure 2:
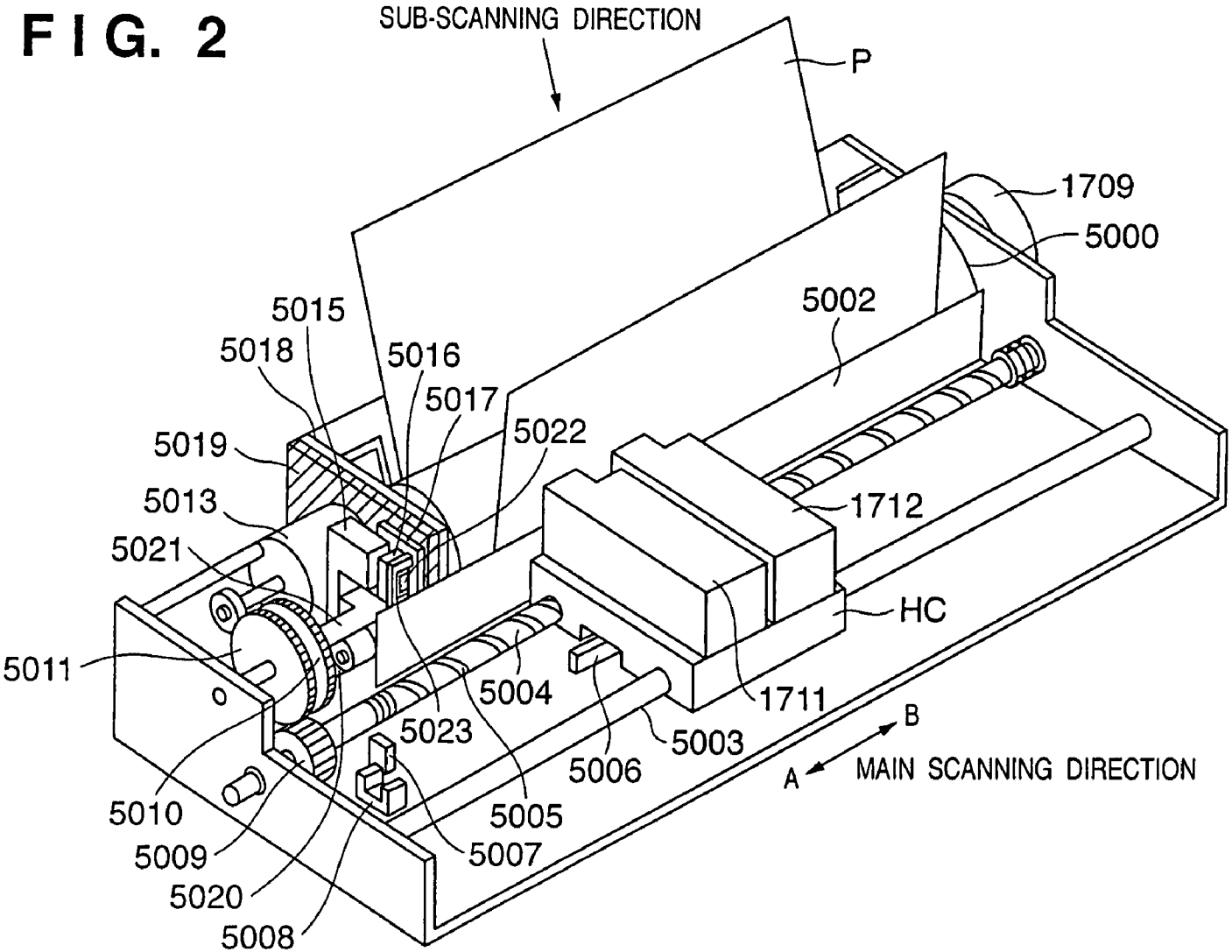
FIG. 2 depicts an external perspective view showing a brief outline of a printer according to the present embodiment.

FIG. 2 depicts an external perspective view showing a brief outline of the printer 105 according to the present embodiment.

In FIG. 2, a printhead carriage HC mounted with an ink-jet cartridge engages a helical channel 5004 of a lead screw 5005, and moves back and forth in the directions indicated by the arrows A and B along a shaft 5003 in accordance with a rotational direction of the lead screw 5005. The rotation of the lead screw 5005 is caused by transmission of the rotation of a carriage motor 5013 via transmission gears 5009 to 5011. The ink-jet cartridge is a head cartridge with an integrally built-in inkjet printhead for ejecting ink and ink tank for accommodating ink. A cartridge 1711 for color printing and a cartridge 1712 for black printing may be independently mounted as the head cartridge.

Reference numeral 5002 denotes a paper pressing plate which presses a sheet P to a platen 5000 across the traveling direction of the carriage HC. Reference numerals 5007 and 5008 denote photo-couplers which generate home position detection signals for verifying the presence of a lever 5006 of the carriage HC in this area (home position). Upon bidirectional printing, the direction of rotation of the motor 5013 is switched over based on the detection signals. A conveyance motor 1709 rotationally drives the platen 5000 to move the sheet P in a sub-scanning direction.

Reference numeral 5016 denotes a member for supporting a cap member 5022 which caps the front face of the printhead, while reference numeral 5015 denotes a suction unit which attracts the cap member 5022. Upon suction recovery of the printhead, the suction unit 5015 performs suction recovery of the printhead via an opening 5023 inside the cap. A cleaning blade 5017 contacts the front face of the printhead to wipe off ink. Reference numeral 5019 is a member which supports the blade 5017 so as to be movable back and forth, and both the member 5019 and the blade 5017 are supported by a supporting plate 5018. The blade 5017 need not have this form, and may instead be a well-known cleaning blade. A lever 5021 is a lever for initiating suction for recovery which moves so as to accompany the movement of a cam 5020 which engages the carriage HC, and its movement is controlled by well-known transmission means such as a clutch changeover device to which a driving force from the carriage motor 5013 is applied. The capping, cleaning and suction recovery are arranged so that desired processing is executed at respective corresponding positions by the action of the lead screw 5005 when the carriage HC has arrived in an area on the side of the home position. If the desired operations are arranged to be performed at a well-known timing, any such arrangement may be applied to this embodiment.

A control configuration for executing print control of the above-mentioned apparatus will now be described.

Figure 3:
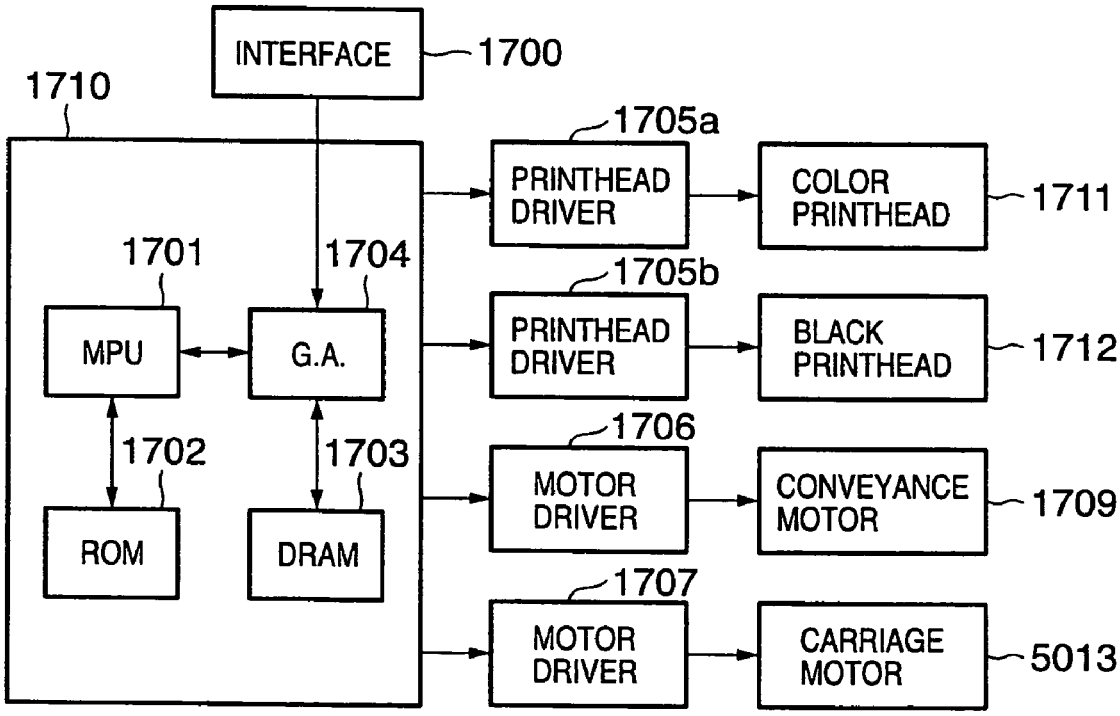
FIG. 3 is a block diagram showing a configuration of the printer according to the present embodiment.

FIG. 3 is a block diagram showing a configuration of the printer 105 according to the present embodiment.

An interface 1700 inputs print data from the host computer 100, and supplies the print data to a controller 1710. An MPU 1701 controls operations of the printer 105 based on a control program stored in the ROM 1702. A DRAM 1703 stores various data (image data, printing data to be supplied to the printhead and the like), and is also used as a work area which temporarily stores various data during control and processing by the MPU 1701. A gate array (G.A.) 1704 controls supply of printing data to the printhead, and also controls data transfer among the interface 1700, the MPU 1701 and the RAM 1703. Printhead drivers 1705*a* and 1705*b* drive printheads 1711 and 1712 according to the printing data of each color from the controller 1710. Motor drivers 1706 and 1707 respectively drive a conveyance motor 1709 and a carriage motor 5013 based on control signals from the controller 1710.

Operations based on the above configuration will now be described. Upon input of the print data to the interface 1700, the print data is converted into the printing data by the gate array 1704 and the MPU 1701. Upon commencement of printing, a rotation of the carriage motor 5013 is initiated by the motor driver 1707 to initiate movement of the carriage HC. Printing is performed when the printheads 1711 and 1712 are driven by outputting the printing data to the printhead drivers 1705*a* and 1705*b* so as to synchronize with the movement of the carriage HC. When printing of a single band is completed in this manner, the sheet P is conveyed a distance equivalent to the width of the band in a sub-scanning direction by the conveyance motor 1709. The operations are repeated to sequentially print an image onto the sheet P.

As described above, while it is assumed that an ink tank and a printhead are integrally formed to configure an ink-jet cartridge, the entire cartridge may be arranged to be replaceable in relation to the printer main body, or an ink tank and a printhead may be configured to be separable so that only the ink tank is replaced when running out of ink.

Figure 4:
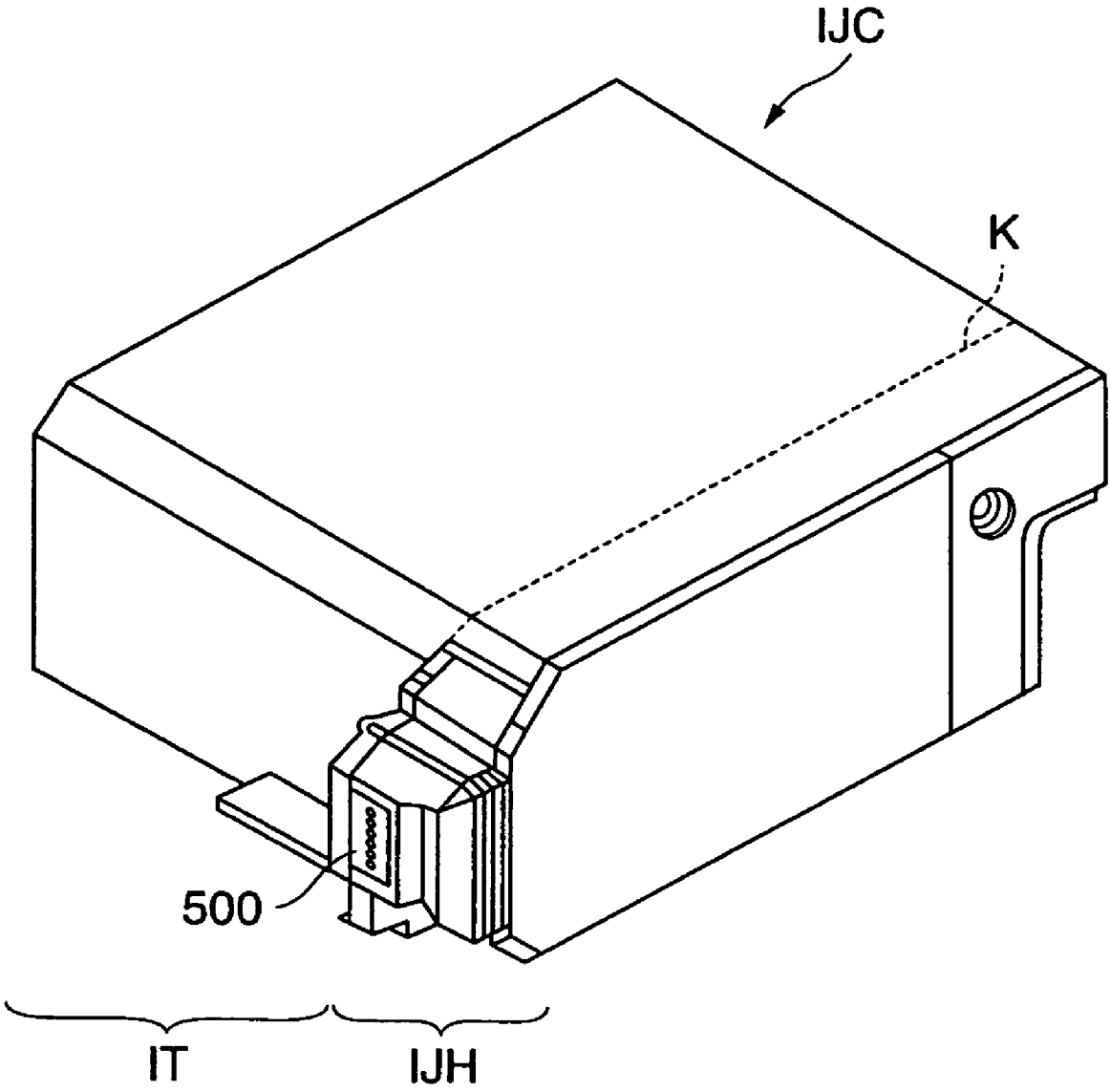
FIG. 4 depicts an external perspective view showing a configuration of an ink-jet cartridge in which an ink tank and a printhead are separable.

FIG. 4 is an external perspective view showing a configuration of an ink-jet cartridge in which an ink tank and an inkjet printhead are separable.

The ink tank IT and the printhead IJH of the ink-jet cartridge IJC are separable at the position of the borderline K. When mounted on the carriage HC, the ink-jet cartridge IJC is provided with an electrode (not shown) for receiving electric signals supplied from the carriage HC side. As described earlier, the printhead IJH is driven by the electrical signals to discharge ink. In FIG. 4, reference numeral 500 denotes a row of ink discharge ports (nozzles). An ink absorbing body consisting of a fibrous or porous material is provided in the ink tank IT in order to retain ink.

Regardless of whether the head cartridge has an integrally formed ink tank and inkjet printhead, or the inkjet cartridge has an ink tank and an inkjet printhead which are separable, the controller 1710 of the printer 105 is capable of discriminating an attachment/detachment of the head cartridge and identifying the type of a mounted ink-jet cartridge by detecting signals via the afore-mentioned electrode.

Next, a flow of processing according to the present embodiment will be described. While the printer 105 according to the present embodiment uses an ink-jet cartridge (head cartridge) configured by an integrally formed ink tank and inkjet printhead, the ink-jet cartridge may be arranged so that the ink tank and inkjet printhead are separable. In the description below, the printer 105 allows use of three different combinations, namely: both color inkjet head cartridges and a black inkjet head cartridge; only the color inkjet head cartridges; and only the black inkjet head cartridge.

Figure 5:
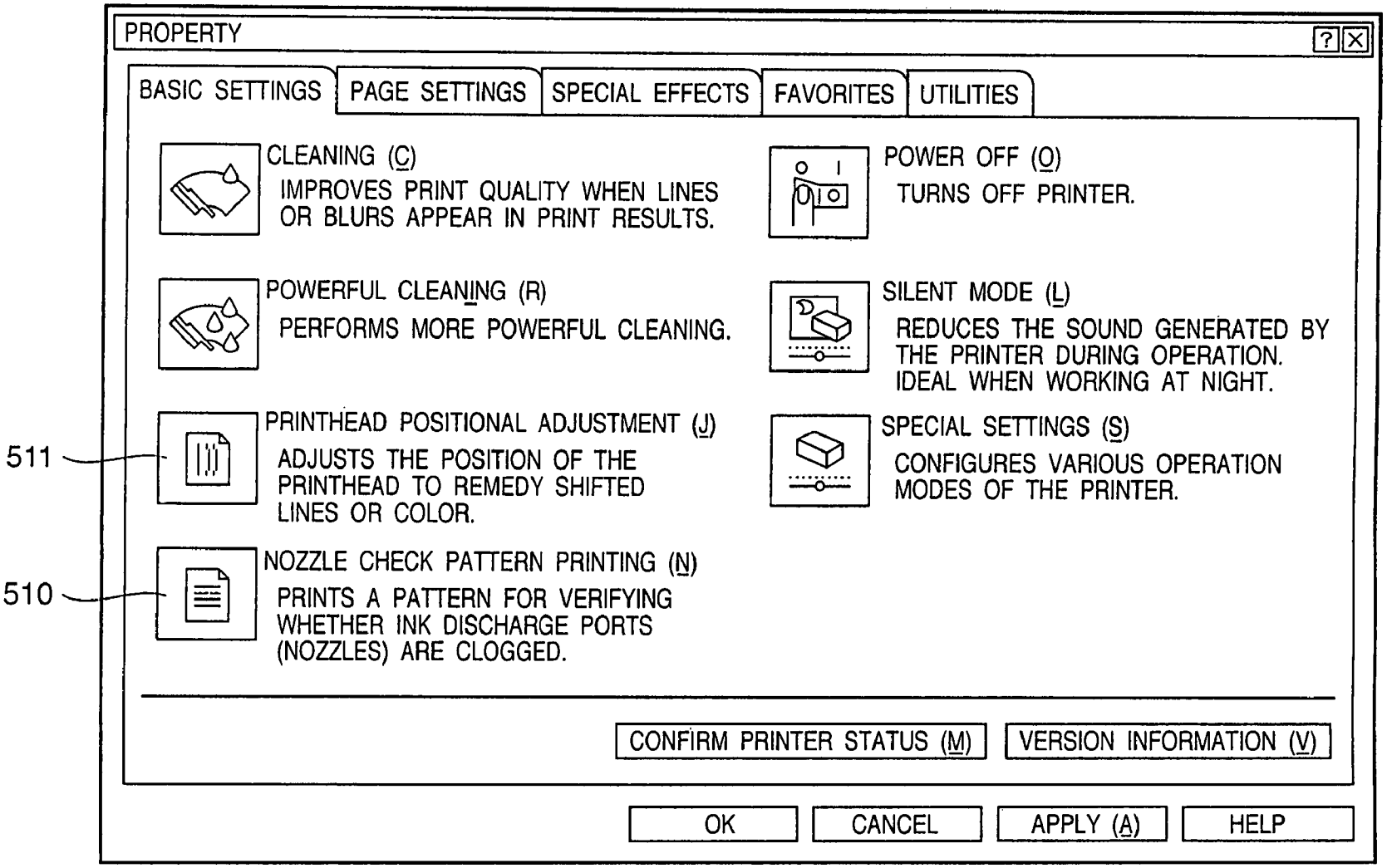
FIG. 5 is a diagram showing an example of a UI screen of a printer driver according to the present embodiment.

FIG. 5 depicts a view illustrating an example of a UI screen of the printer driver 103 according to the present embodiment.

The screen shown in FIG. 5 is an example of a screen for verifying the status of the head cartridge mounted on the printer 105, and for configuring various settings for the printer. The screen shows a display example of a case where "property" has been selected on the UI screen of the printer driver 103, and instruction icons such as for printhead cleaning, printhead positional adjustment and nozzle check pattern printing are shown. At this point, when checking clogging of printhead nozzles, a mouse cursor 512 is placed on a "nozzle check pattern printing" button 510, and the mouse button is clicked. A nozzle check pattern is thereby printed by a printer 105 to be controlled, allowing determination of which nozzle of the printer 105 is clogged by the print results.

In addition, when performing positional adjustment of a head cartridge mounted on the printer 105, the mouse cursor 512 is placed on a "printhead positional adjustment" button 511, and the mouse button is clicked. A printhead positional adjustment pattern is thereby printed by the printer 105, and as described later, operation for positional adjustment of the printhead of the printer 105 may be instructed based on the print results.

Figure 6:
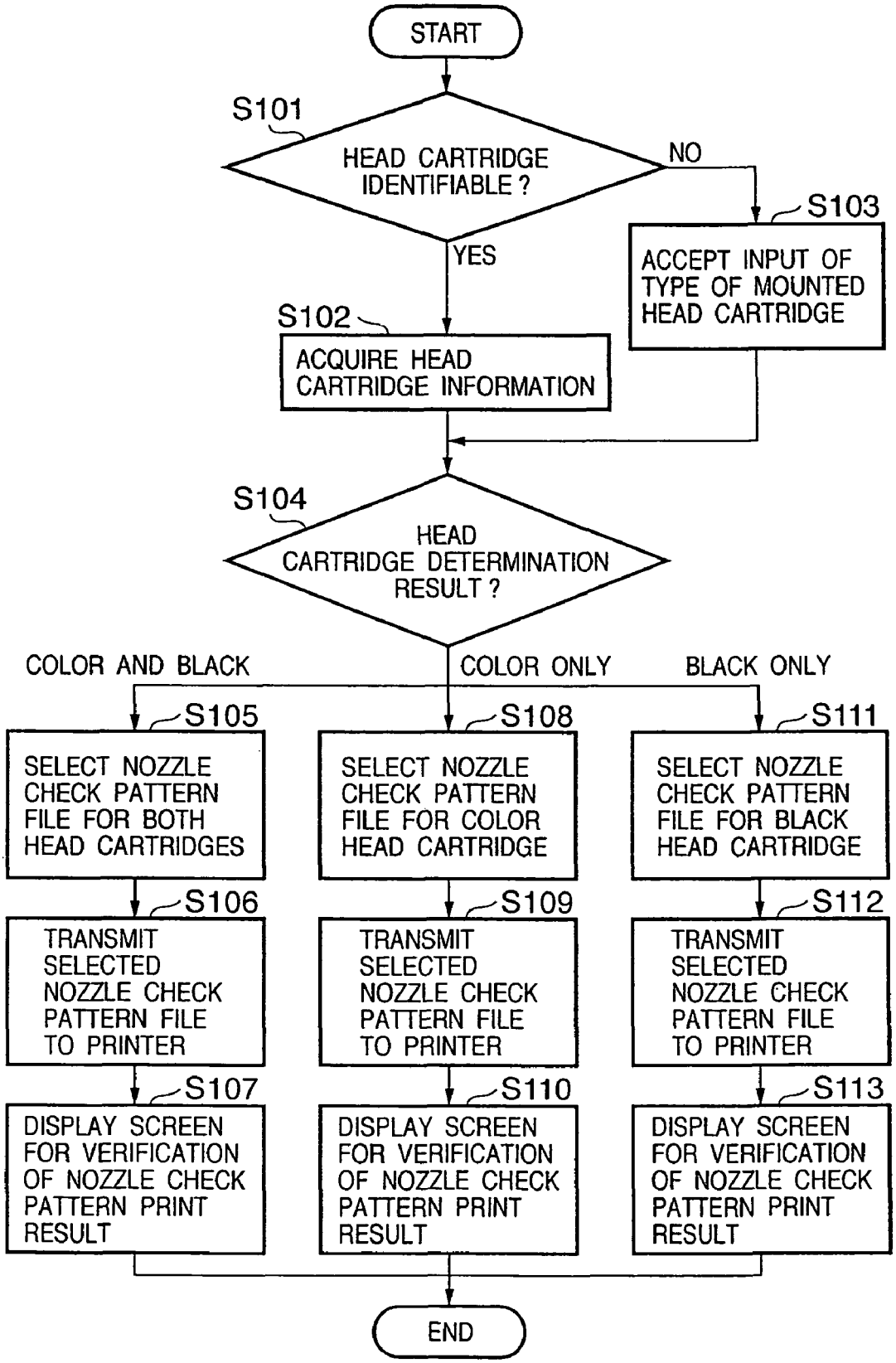
FIG. 6 is a flowchart for explaining a flow of print processing of a nozzle check pattern of an ink-jet cartridge mounted on a printer according to a first embodiment of the present invention.

FIG. 6 is a flowchart for explaining a flow of print processing of a nozzle check pattern for verifying the status of a head cartridge mounted on the printer 105 according to the present embodiment. This processing is performed by the CPU 108 of the host computer 100 by executing the printer driver 103. The processing is initiated when the "nozzle check pattern printing" button 510 shown in FIG. 5 is designated by a mouse or the like.

First, in step S101, it is determined whether a head cartridge is mounted on the printer and whether the type of head cartridge mounted on the printer 105 is identifiable. This is determined based on whether or not the head cartridge is detected, and if the cartridge is mounted and information indicating the type of the head cartridge mounted on the printer 105 can be acquired through bidirectional communication with the printer 105. As described earlier, it is assumed that the printer 105 is capable of determining the attachment/detachment of the cartridge and the type of head cartridge mounted on the head carriage HC based on ID information obtained through electrical connection with the head cartridge. Therefore, normally, the attachment/detachment of the cartridge and the type of head cartridge mounted on the printer 105 may be determined from the type information provided by the printer 105. However, in the event that information regarding the head cartridge mounted on the printer 105 is not obtainable due to reasons such as an interruption of bidirectional communication with the printer 105, the attachment/detachment of the cartridge and the type of head cartridge mounted on the printer 105 are no longer determinable. The determination processing of step S101 is provided in consideration of the above.

In a case that the attachment/detachment of the head cartridge and the type of the head cartridge are identifiable in step S101, the process proceeds to step S102 to acquire cartridge information indicating cartridge type transmitted from the printer 105 and to store the acquired cartridge information in the RAM 109, and then proceeds to step S104. On the other hand, in a case where the head cartridge type is not identifiable in step S101, the process proceeds to step S103 to display a screen onto the monitor 106 for prompting a user to input a type of the head cartridge type. In a case that the attachment and the type of the head cartridge are specified through user input, the process proceeds to step S104.

FIG. 7 depicts a view illustrating an example of a UI screen displayed on a monitor in step S103 of FIG. 6.

In the example shown in FIG. 7, since information regarding the head cartridge mounted on the printer is not obtainable, a message reading "Printer information cannot be obtained. Select mounted head cartridge" is displayed, and the head cartridge types of "Color only", "Black only" and "Both" (color and black) are further provided as selectable options. When the checkbox of the corresponding item is checked and an OK button is specified, the checked head cartridge type is set. In FIG. 7, the type of head cartridge is shown as "Color only".

Next, in step S104, the type of head cartridge mounted on the printer 105 is determined based either on cartridge information obtained from the printer 105 in step S102 or the head cartridge type specified in step S103. In this case, the head cartridge is determined to be any of "Color only", "Black only" or "Both". If the head cartridge is determined to be "Both", or, in other words, if it is determined that both color and black head cartridges are mounted, the process proceeds to step S105 to select a nozzle check pattern file in the possession of the printer driver 103 for both head cartridges. The pattern data (test data) of the nozzle check pattern file is a test data for detecting the presence or absence of discharged ink corresponding to the nozzle arrangement of the printheads (head cartridges). In step S106, the selected pattern file is transmitted to the printer 105, and the nozzle check patterns for the head cartridges are printed out using the head cartridges of the printer 105. Next, in step S107, a screen for verifying the nozzle check pattern print results is displayed on the monitor 106. This enables the user to determine the cleaning of which head cartridge is necessary by comparing the actual printed pattern to the pattern of the displayed screen.

Figure 8:
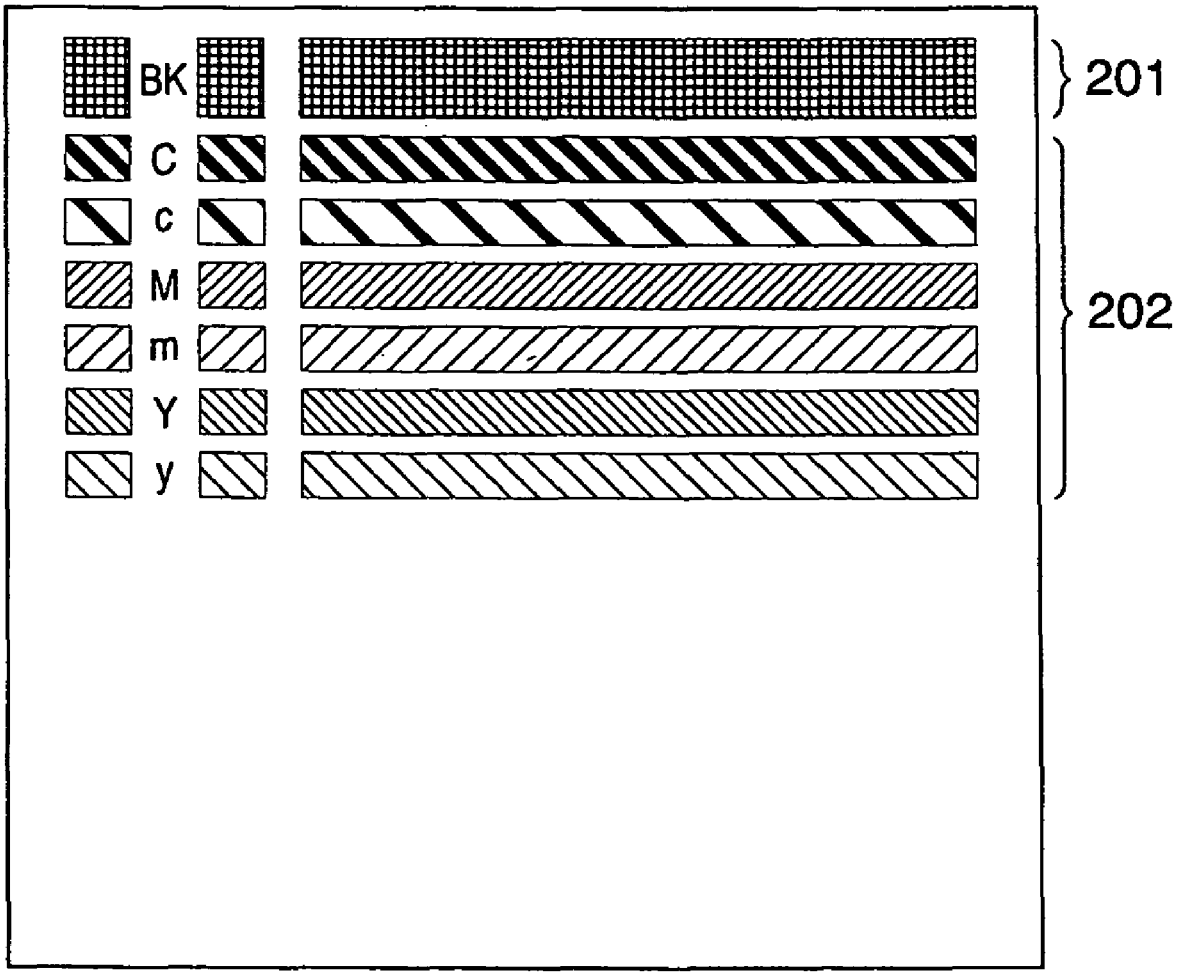
FIG. 8 depicts a view illustrating an example of normally printed nozzle check patterns for color and black ink-jet cartridges according to the present embodiment.

FIG. 8 is a diagram showing a normal print example of nozzle check patterns for color and black ink-jet head cartridges according to the present embodiment.

In this case, the example shows patterns printed by inks of the colors of black (Bk), cyan (C), pale cyan (c), magenta (M), pale magenta (m), yellow (Y) and pale yellow (y). The number of the nozzles of the black head cartridge may be different from the number of the nozzles of the color head cartridge is also possible. This also applies to the following embodiments.

Figure 9:
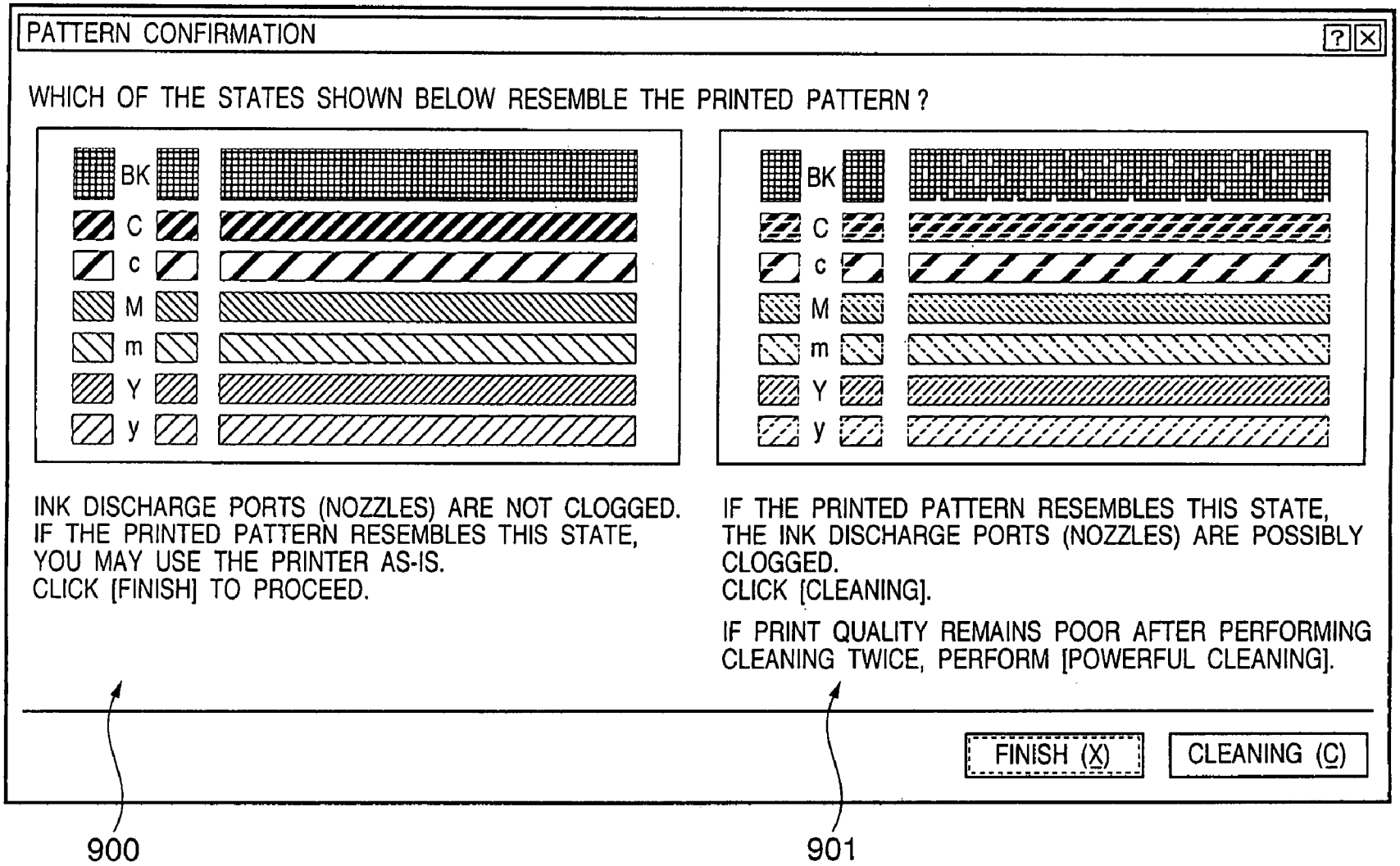
FIG. 9 depicts a view illustrating an example of a screen displayed on a monitor in step S107 of FIG. 6 for verifying printed results of nozzle check patterns.

FIG. 9 depicts a view illustrating an example of a screen displayed on a monitor in step S107 of FIG. 6 for verifying printed results of nozzle check patterns.

Reference numeral 900 indicates a normal print result, while reference numeral 901 indicates an example of a print result where a clogged nozzle exists. By comparing the actual print result to the display examples on the screen, the user will be able to determine whether either the black printhead or the color printhead, or both printheads require cleaning, depending on which state the printed results closely resembles.

On the other hand, if it is determined in step S104 that the head cartridge is determined to be "Color", or, in other words, if it is determined that only color head cartridges are mounted, the process proceeds to step S108 to select a nozzle check pattern file in the possession of the printer driver 103 for the color head cartridges. In step S109, the selected pattern file is transmitted to the printer 105, and the nozzle check patterns for the color head cartridges are printed out by the printer 105. Next, in step S110, a screen for verifying the printed results of the nozzle check patterns is displayed on the monitor 106. This enables the user to determine the cleaning of which color head cartridge is necessary by comparing the actual printed pattern to the pattern of the displayed screen.

Figure 10:
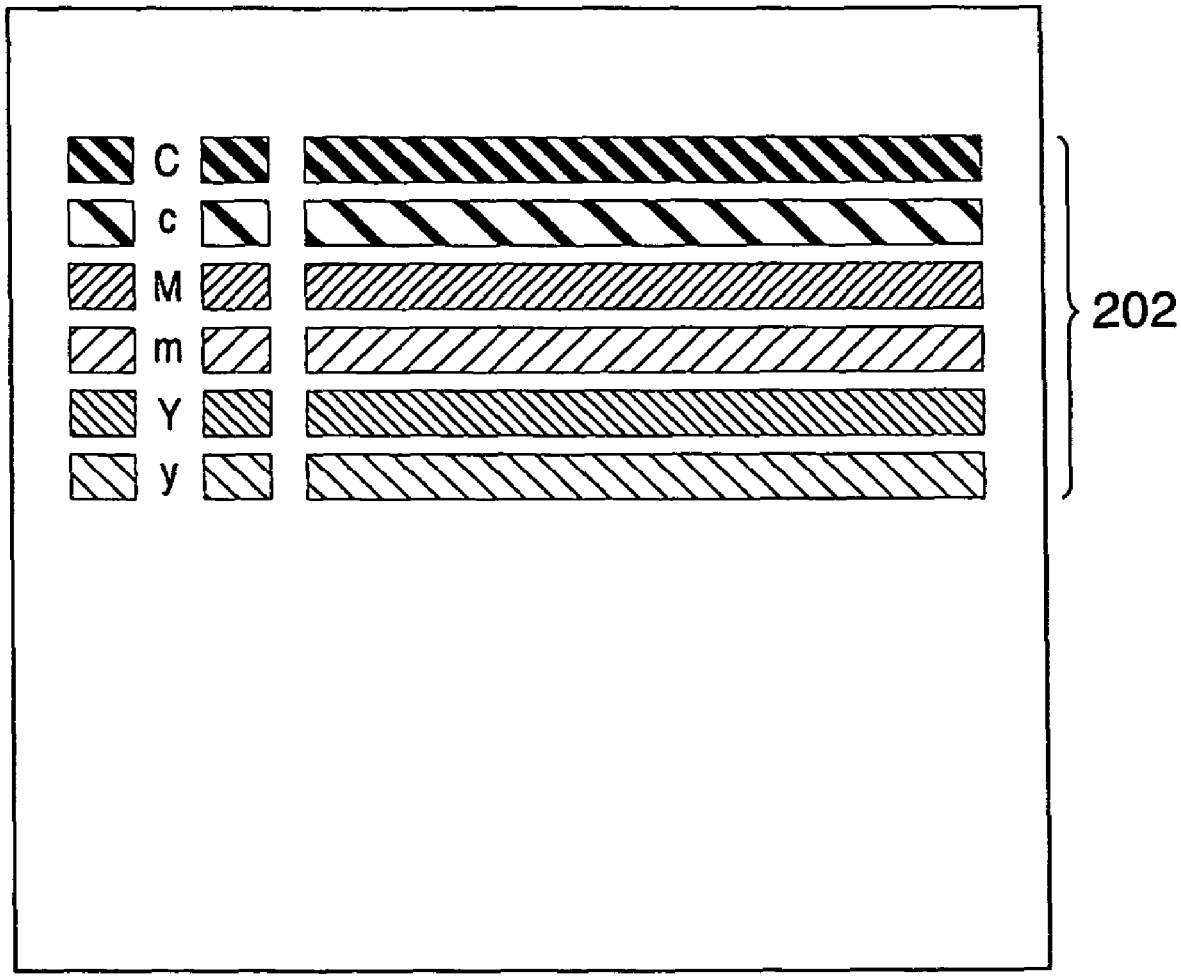
FIG. 10 depicts a view illustrating an example of normally printed nozzle check patterns for color ink-jet cartridges according to the present embodiment.

FIG. 10 depicts a view of an example of a normal printed results of nozzle check patterns for color head cartridges according to the present embodiment.

In this case, the patterns are obtained by removing a black check pattern from the example shown in FIG. 8, or in other words, the patterns printed by inks of the colors of cyan (C), pale cyan (c), magenta (M), pale magenta (m), yellow (Y) and pale yellow (y), are shown.

Figure 11:
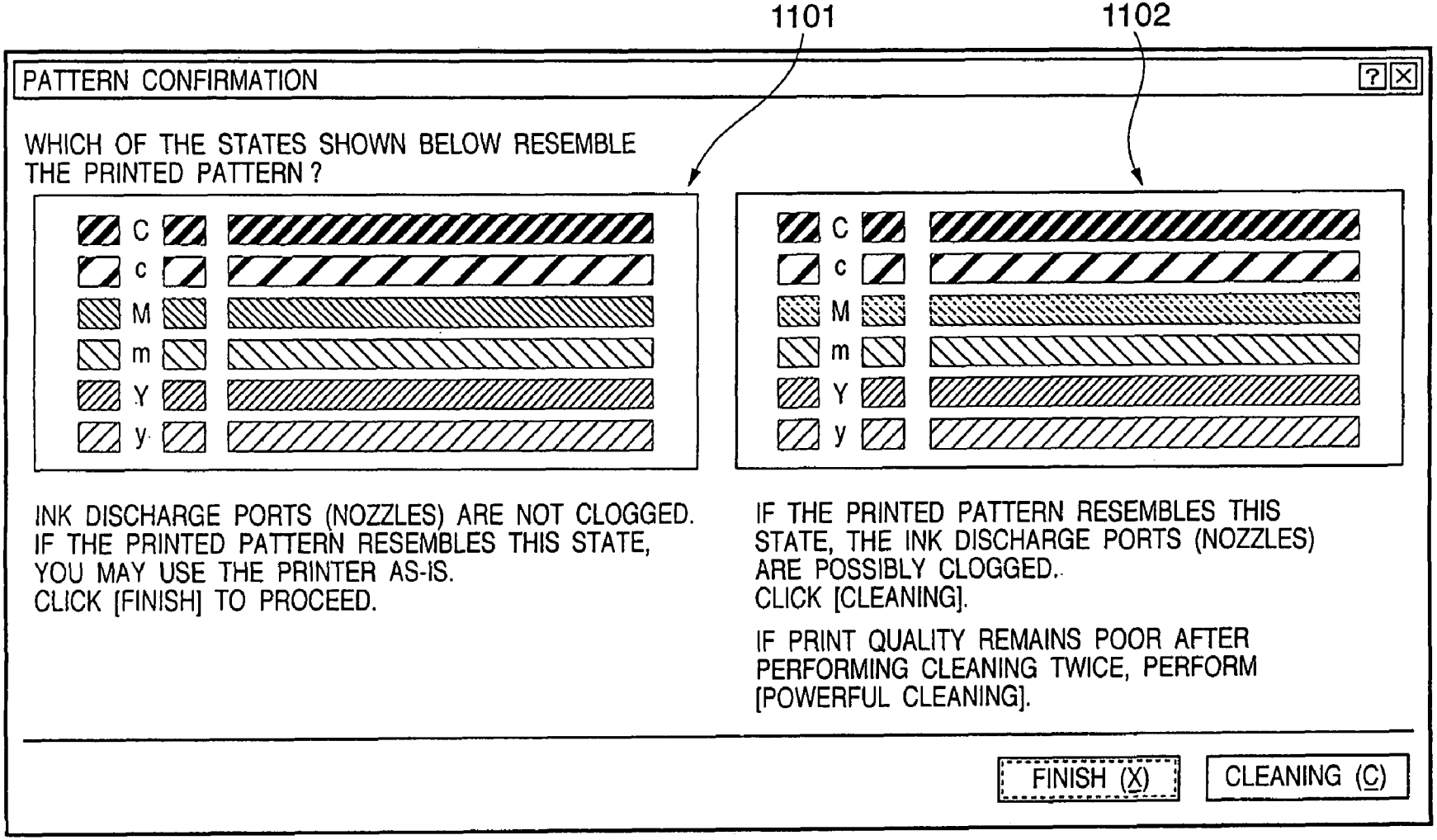
FIG. 11 depicts a view illustrating an example of a screen displayed on a monitor in step S110 of FIG. 6 for verifying printed results of nozzle check patterns.

FIG. 11 depicts a view illustrating an example of a screen displayed on a monitor in step S110 of FIG. 6 for verifying printed results of nozzle check patterns.

Reference numeral 1101 indicates a normal printed result, while reference numeral 1102 indicates an example of print resulted where a clogged nozzle exists. By comparing the actual printed result to the display examples on the screen, the user will be able to determine the cleaning of which of the color head cartridge is required depending on which state of the printed results closely resembles.

In addition, if it is determined in step S104 that the head cartridge is determined to be "Black", or, in other words, if it is determined that only a black head cartridge is mounted, the process proceeds to step S111 to select a nozzle check pattern file in the possession of the printer driver 103 for the black head cartridge. In step S112, the selected pattern file is transmitted to the printer 105, and the nozzle check pattern is printed out by the printer 105. Next, in step S113, a screen for verifying the printed results of the nozzle check pattern is displayed on the monitor 106. This enables the user to determine whether cleaning of the black head cartridge is necessary by comparing the actual printed pattern to the pattern of the displayed screen.

An example of a printed result of a nozzle check pattern when only the black head is mounted, and a diagram illustrating a verification screen thereof will be omitted. However, in this case, an example of the printed result of the nozzle check pattern will resemble, for instance, the Bk pattern 201 shown in FIG. 8, and the verification screen thereof may be the Bk pattern example shown in FIG. 9.

Figure 12:
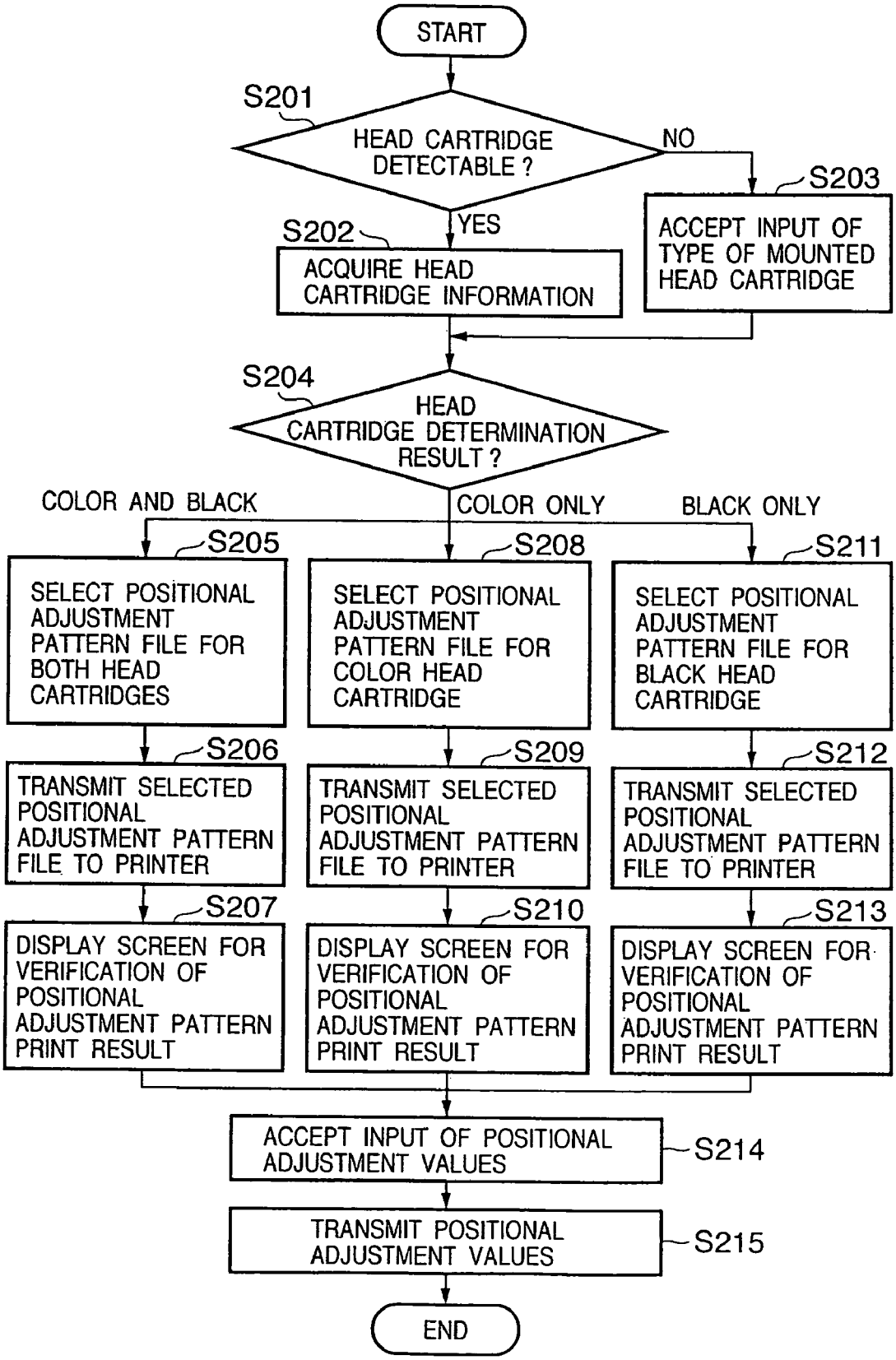
FIG. 12 is a flowchart for explaining a flow of print processing of a pattern for positional adjustment of a printhead for performing positional adjustment of an ink-jet cartridge mounted on a printer according to a first embodiment of the present invention.

FIG. 12 is a flowchart for explaining a flow of print processing of a printhead positional adjustment pattern for performing positional adjustment of a head cartridge mounted on the printer 105 according to the present embodiment. This processing is performed by the CPU 108 of the host computer 100 by executing the printer driver 103. The processing is initiated when the "printhead positional adjustment" button 511 shown in FIG. 5 is designated by a mouse or the like.

Since the processing of steps S201 to S204 are identical to the above-described steps S101 to S104 of FIG. 6, a description thereof will be omitted.

In step S204, the type of head cartridge mounted on the printer 105 is determined based either on cartridge information obtained from the printer 105 in step S202 or the head cartridge type specified in step S203. In this case, the head cartridge is determined to be any of "Color only", "Black only" or "Both". If the head cartridge is determined to be "Both", or, in other words, if it is determined that both color and black head cartridges are mounted, the process proceeds to step S205 to select a printhead positional adjustment pattern file in the possession of the printer driver 103 for both head cartridges. In step S206, the selected pattern file is transmitted to the printer 105, and the printhead positional adjustment pattern is printed out by the printer 105. Next, in step S207, a screen for verifying the printhead positional adjustment pattern print results is displayed on the monitor 106. This enables the user to determine the positional adjustment of which printhead is necessary by comparing the actual printed pattern to the pattern of the displayed screen.

Figure 13:
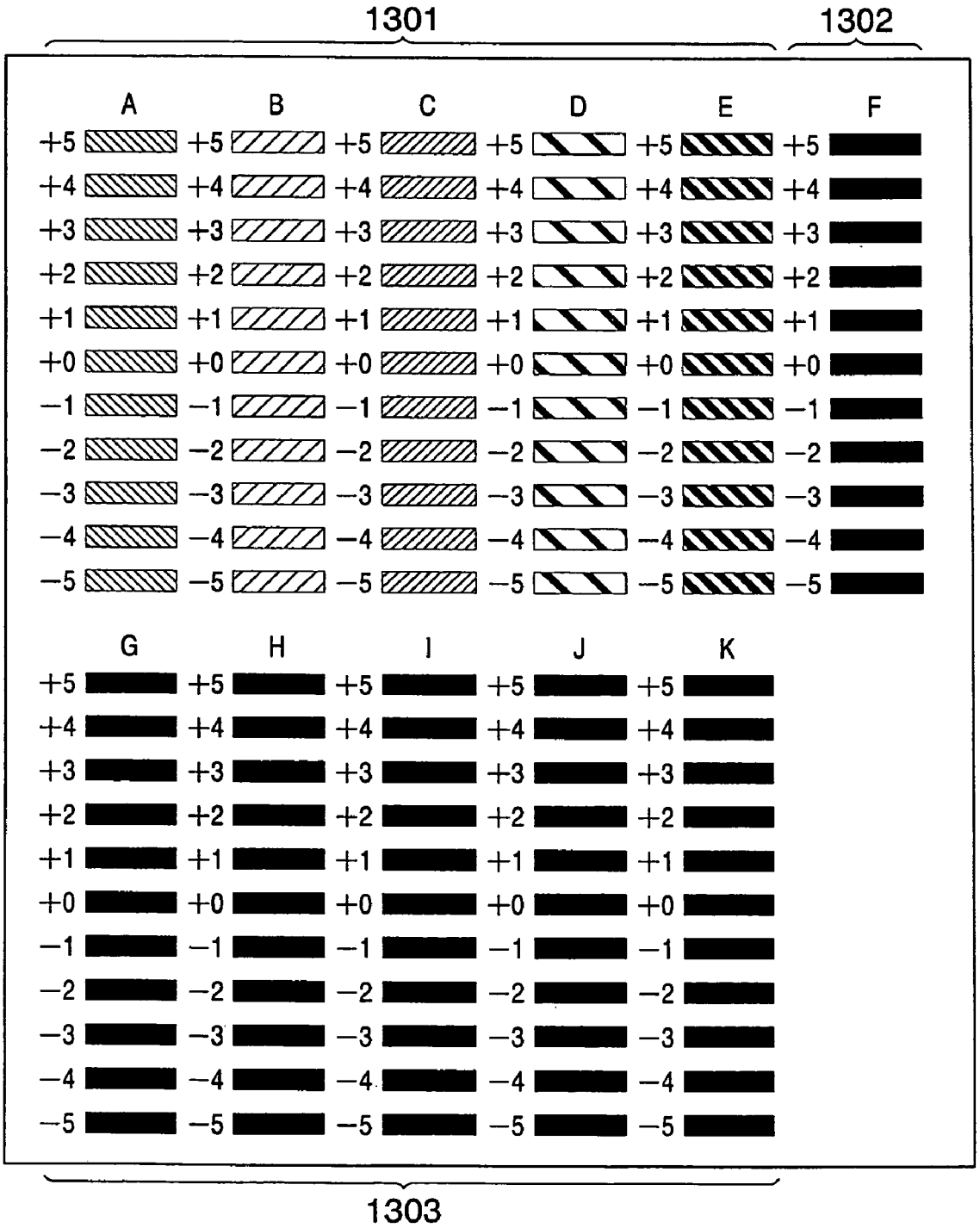
FIG. 13 depicts a view illustrating an example of printed results of a printhead positional adjustment pattern for color and black ink-jet cartridges according to the present embodiment.

FIG. 13 depicts a view illustrating an example of printed results of a printhead positional adjustment pattern for color and black ink-jet cartridges according to the present embodiment.

In this example, the printhead positional adjustment pattern is composed of patterns of columns A to K comprising patterns 1301 for color head cartridges, a pattern 1302 for a black head cartridge, and correction patterns 1303 for correcting between the color head cartridges and the black head cartridge. Each pattern is composed of eleven rows, and each row is assigned numbers from "+5" to "−5".

Figure 14:
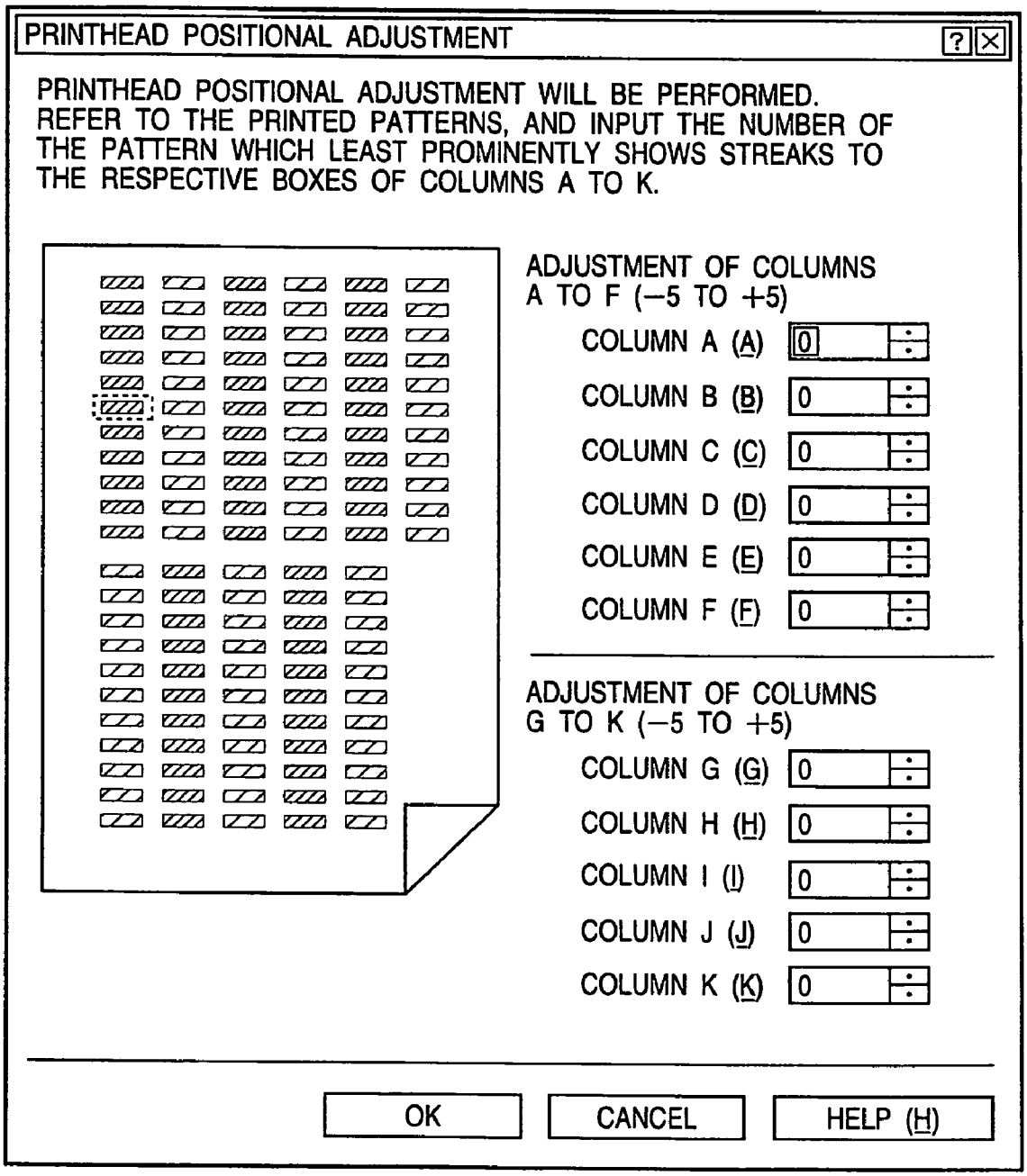
FIG. 14 depicts a view illustrating an example of a screen displayed on a monitor in step S207 of FIG. 12 for verifying printed results of a printhead positional adjustment pattern.

FIG. 14 depicts a view illustrating an example of a screen displayed on a monitor in step S207 of FIG. 12 for verifying printed results of a printhead positional adjustment pattern.

Next, in step S214, the user determines a number (any of the numbers "+5" to "−5") of a pattern in each of the columns A to K in which streaks are most unnoticeable, and adjustment data to be inputted by number is accepted for each column. In step S215, the values thus inputted are stored in a table (not shown) of the printer driver 103, and are also transmitted to the printer 105. The adjustment data will be used for the positional adjustment of print data outputted to each head cartridge (printhead). Since the technique for performing positional adjustment of each printhead according to the inputted positional adjustment data for each printhead is well known, a description thereof will be omitted.

On the other hand, if it is determined in step S204 that the head cartridge is determined to be "Color", or, in other words, if it is determined that only color head cartridges are mounted, the process proceeds to step S208 to select a printhead positional adjustment pattern file in the possession of the printer driver 103 for the color head cartridges. In step S209, the selected pattern file is transmitted to the printer 105, and the printhead positional adjustment pattern is printed out by the printer 105. Next, in step S210, a screen for verifying the printhead positional adjustment pattern print result is displayed on the monitor 106. This enables the user to determine in step S214 that the positional adjustment of which color head cartridges is necessary by comparing the actual printed pattern to the pattern of the displayed screen. In step S215, the positional adjustment data is stored in a table (not shown) of the printer driver 103 and also transmitted to the printer 105.

Figure 15:
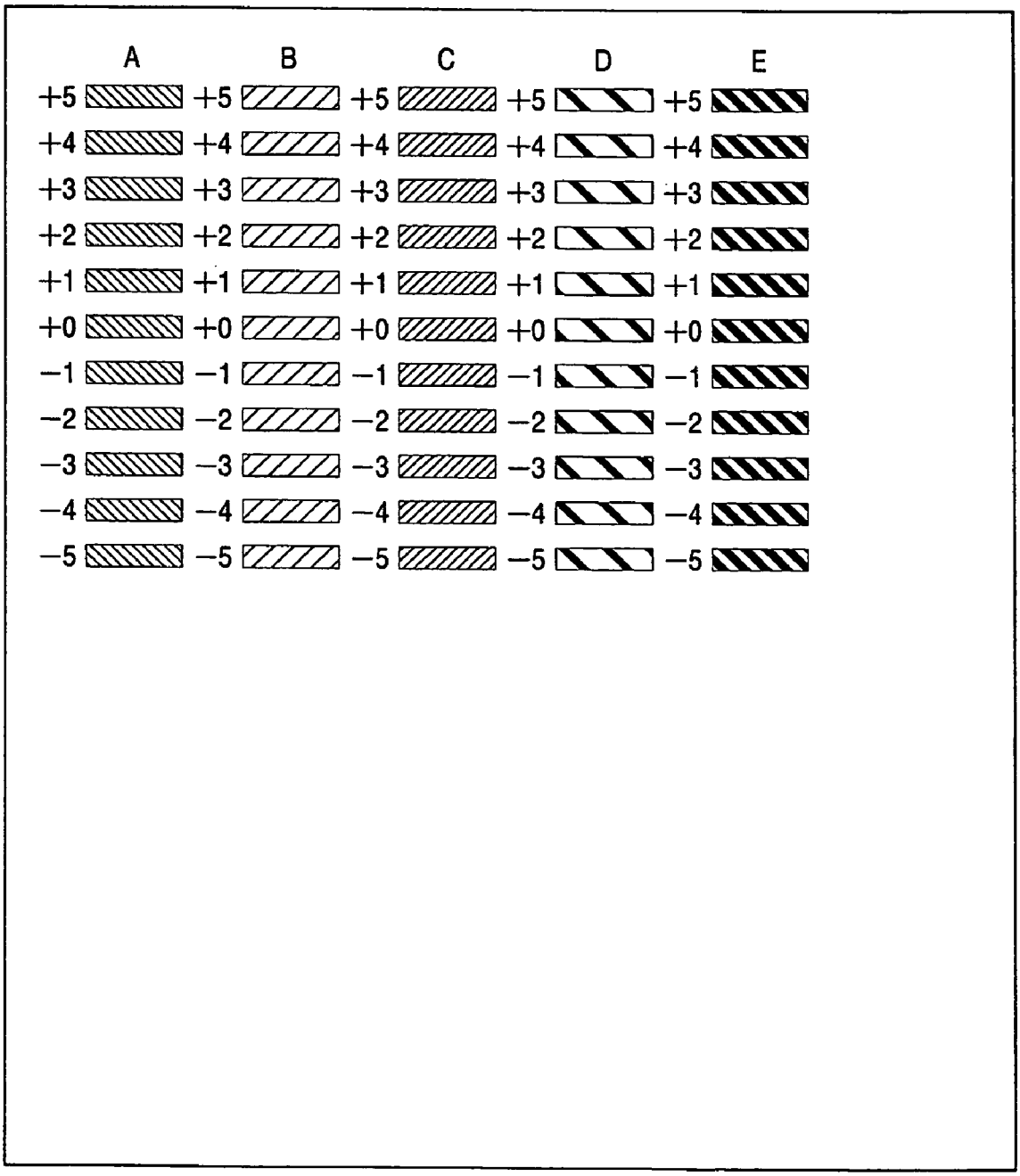
FIG. 15 depicts a view illustrating an example of printed results of a printhead positional adjustment pattern for a color ink-jet cartridge selected in step S208 of FIG. 12.

FIG. 15 depicts a view showing an example of a printed result of a printhead positional adjustment pattern for color head cartridges selected in step S208 of FIG. 12. In this example, a pattern identical to the patterns 1301 for the color head cartridges shown in FIG. 13 have been printed.

Figure 16:
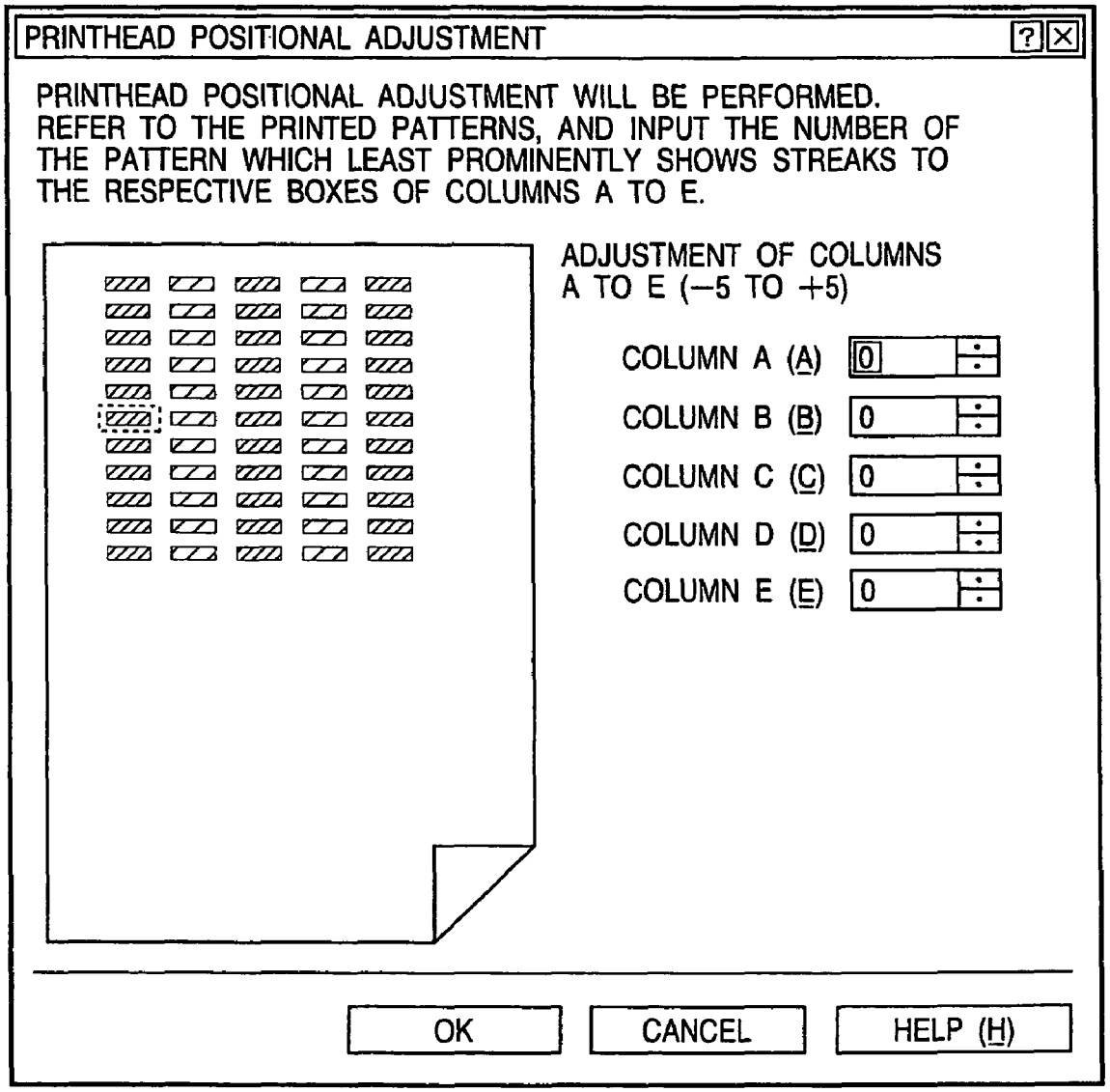
FIG. 16 depicts a view illustrating an example of a screen displayed on a monitor in step S210 of FIG. 12 for verifying printed results of a printhead positional adjustment pattern.

FIG. 16 depicts a view showing an example screen displayed on the monitor 106 in step S210 of FIG. 12 for verifying printed results of the printhead positional adjustment pattern.

Next, in step S214, the user determines a number (any of the numbers "+5" to "−5") of the patterns in each of the columns A to E in which streaks are most unnoticeable, and adjustment data to be inputted by the number is accepted for each column. In step S215, the values thus inputted are stored in a table (not shown) of the printer driver 103, and are also transmitted to the printer 105. The adjustment data will be used for positional adjustment of printing data outputted to each head cartridge (printhead).

In addition, if it is determined in step S204 that the head cartridge is determined to be "Black", or, in other words, if it is determined that only a black head cartridge is mounted, the process proceeds to step S211 to select a printhead positional adjustment pattern file in the possession of the printer driver 103 for the black head cartridge. In step S212, the selected pattern file is transmitted to the printer 105, and the printhead positional adjustment pattern is printed out by the printer 105. Next, in step S213, a screen for verifying the printed results of the printhead positional adjustment pattern is displayed on the monitor 106. This enables the user to comparing the actual printed pattern to the pattern of the displayed screen to input the printhead positional adjustment data for the black head cartridge.

An example of a printed result of the printhead positional adjustment pattern when only the black head is mounted and a diagram illustrating a verification screen thereof will be omitted. In this case, an example of the printed result of the nozzle check pattern will resemble, for instance, the Bk pattern shown in FIG. 13 indicated by the columns F to K, and the verification screen thereof may be the one shown in FIG. 14 which accepts input of pattern numbers for the columns F to K.

In step S214, the printhead positional adjustment data for the black head cartridge, which is inputted by the user after referencing the actual printed pattern to the pattern of the displayed screen, is accepted. Next, in step S215, the positional adjustment data is stored in a table (not shown) of the printer driver 103 and also transmitted to the printer 105. The printhead positional adjustment data for the black head cartridge is thereby inputted.

As described, according to the first embodiment, a nozzle check pattern or a printhead positional adjustment pattern may be transmitted to the printer to be printed according to the type of inkjet printhead (head cartridge) mounted on the printer. This allows detection of presence/absence of ink discharge from each nozzle of the printer, as well as adjustment of printhead positions.

Second Embodiment

In the above-described first embodiment, a printer driver stores nozzle check pattern files and printhead positional adjustment pattern files for black and/or color head cartridges. A description has been provided on a case where a nozzle check pattern file or a printhead positional adjustment pattern file corresponding to information regarding a head cartridge mounted on the printer was transmitted from the printer driver 103 to the printer 105.

In contrast, for the second embodiment, a case will be described wherein information necessary for creating nozzle check pattern files and printhead positional adjustment pattern files are stored in the printer driver 103, and a pattern file corresponding to the information of the head cartridge mounted on the printer 105 will be created and transmitted to the printer 105.

Figure 17:
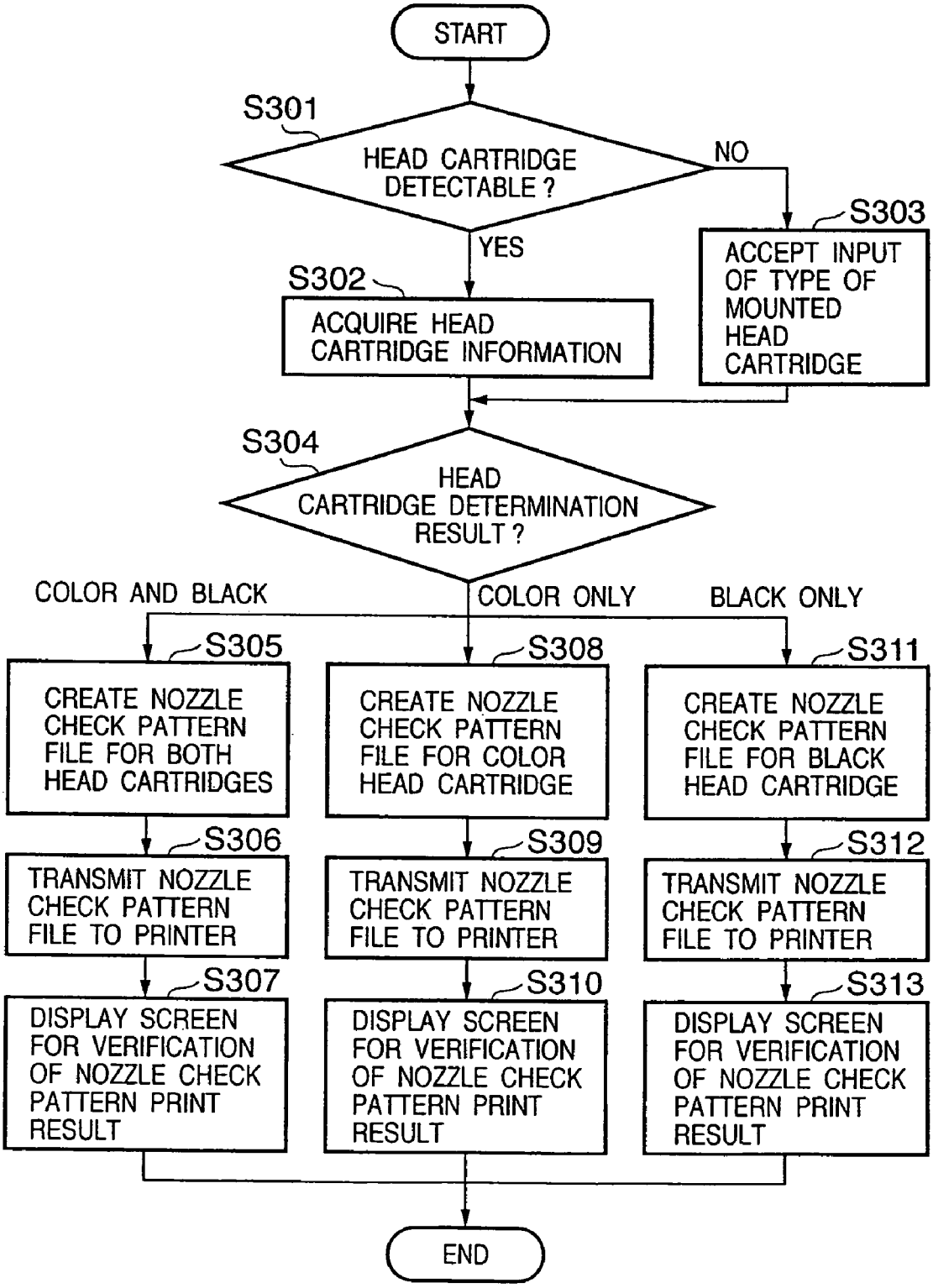
FIG. 17 is a flowchart for explaining a flow of print processing of a nozzle check pattern of an ink-jet cartridge mounted on a printer according to a second embodiment of the present invention.

FIG. 17 is a flowchart for explaining a flow of print processing of a nozzle check pattern for verifying the status of an ink-jet cartridge mounted on the printer 105 according to the second embodiment of the present invention. This processing is performed by the CPU 108 of the host computer 100 by executing the printer driver 103. The processing is initiated when the "nozzle check pattern printing" button 510 shown in FIG. 5 is designated by a mouse or the like. Since the processing of steps S301 to S304 are identical to the above-described steps S101 to S104 of FIG. 6, a description thereof will be omitted.

In step S304, the type of head cartridge mounted on the printer 105 is determined based either on cartridge information obtained from the printer 105 in step S302 or the head cartridge type specified in step S303. In this case, the head cartridge is determined to be any of "Color only", "Black only" or "Both". If the head cartridge is determined to be "Both", or, in other words, if it is determined that both color and black head cartridges are mounted, the process proceeds to step S305 to create a nozzle check pattern file for both color and black head cartridges. The creation of the pattern file is performed according to a predetermined algorithm using a pattern creation module of the printer driver 103. In step S306, the created pattern file is transmitted to the printer 105, and the nozzle check pattern is printed out by the printer 105. Next, in step S307, a screen for verifying the nozzle check pattern printed result is displayed on the monitor 106. This enables the user to determine whether the cleaning of which head cartridge is necessary by comparing the actual printed pattern to the pattern of the displayed screen. In this case, the check pattern for the color and black head cartridges as well as an example of the verification screen therefor are identical to the case of the afore-mentioned first embodiment shown in FIGS. 8 and 9, and a description thereof will be omitted.

On the other hand, if it is determined in step S304 that the head cartridge is determined to be "Color", or, in other words, if it is determined that only color head cartridges are mounted, the process proceeds to step S308 to create a nozzle check pattern file for the color head cartridges in the same manner as in step S305 described above. In step S309, the created pattern file is transmitted to the printer 105, and the nozzle check pattern is printed out by the printer 105. Next, in step S310, a screen for verifying the nozzle check pattern printed result is displayed on the monitor 106. This enables the user to determine whether the cleaning of the color head cartridges is necessary by comparing the actual printed pattern to the pattern of the displayed screen. In this case, the check patterns for the color head cartridges as well as an example of the verification screen therefor are identical to the case of the afore-mentioned first embodiment shown in FIGS. 10 and 11, and a description thereof will be omitted.

On the other hand, if it is determined in step S304 that the head cartridge is determined to be "Black", or, in other words, if it is determined that only a black head cartridge is mounted, the process proceeds to step S311 to create a nozzle check pattern file for the black head cartridge in the same manner as in step S305. In step S312, the created pattern file is transmitted to the printer 105, and the nozzle check pattern is printed out by the printer 105. Next, in step S313, a screen for verifying the nozzle check pattern printed result is displayed on the monitor 106. This enables the user to determine whether the cleaning of the black head cartridge is necessary by comparing the actual printed pattern to the pattern of the displayed screen.

In this case, an example of a printed result of a nozzle check pattern when only the black head cartridge is mounted, and an example of a verification screen therefor will respectively resemble, for instance, the Bk pattern shown in FIG. 8, and the verification screen thereof may be the Bk pattern example shown in FIG. 9.

Figure 18:
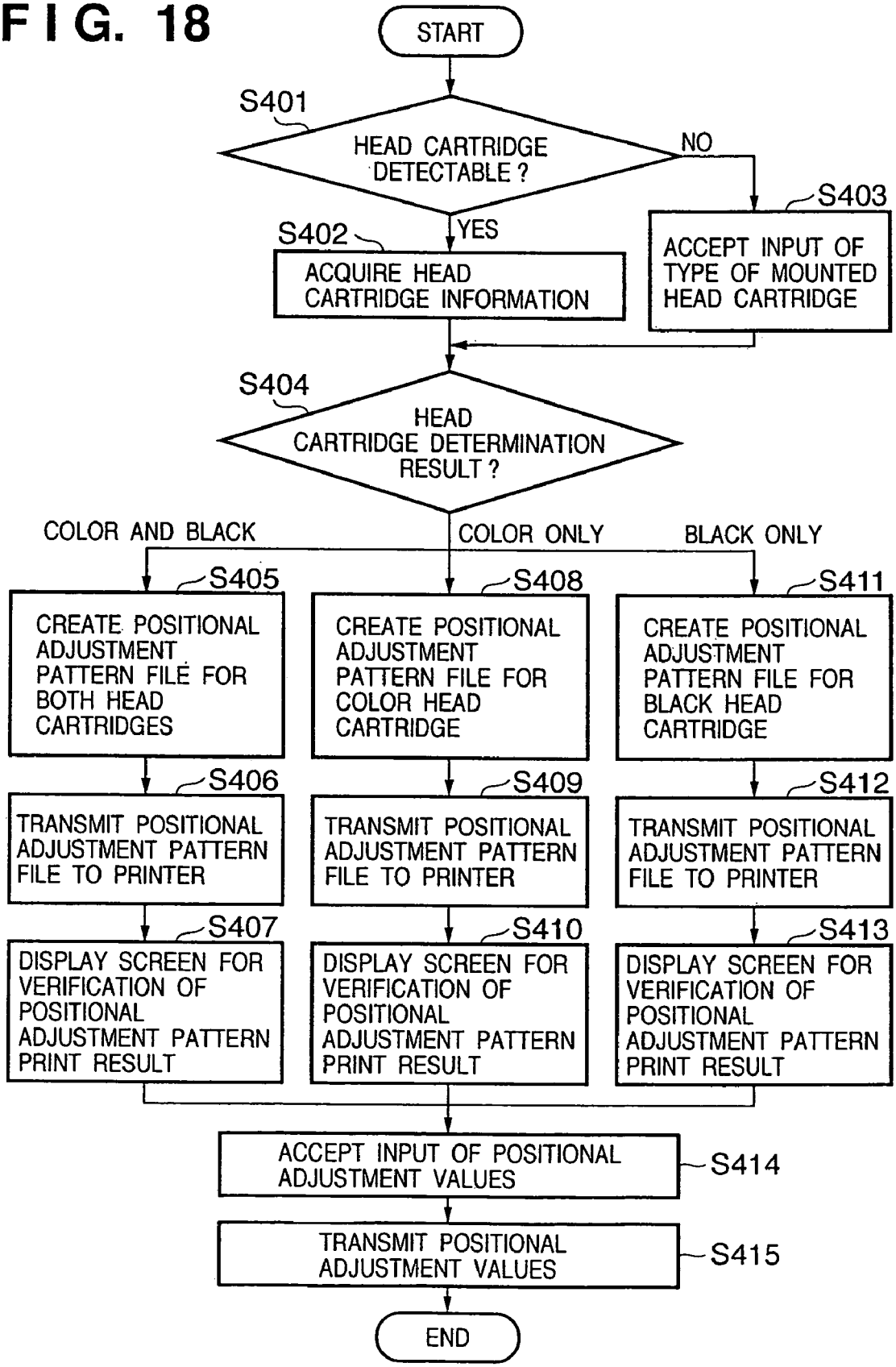
FIG. 18 is a flowchart for explaining a flow of print processing of a printhead positional adjustment pattern for performing positional adjustment of an ink-jet cartridge mounted on a printer according to the second embodiment of the present invention.

FIG. 18 is a flowchart for explaining a flow of print processing of a printhead positional adjustment pattern for performing positional adjustment of an ink-jet cartridge mounted on the printer 105 according to the second embodiment of the present invention. This processing is performed by the CPU 108 of the host computer 100 by executing the printer driver 103. The processing is initiated when the "printhead positional adjustment" button 511 shown in FIG. 5 is specified by a mouse or the like.

With the exception of the steps S405, S408 and S411, the processing steps of S401 to S415 are identical to the steps S201 to S204, S206, S207, S209, S210, S212, S213 to S215 in above-described FIG. 12, and therefore a description thereof will be omitted.

In step S405, a printhead positional adjustment pattern file is created for a case where both color and black head cartridges are used. In step S406, the file created in step S405 is transmitted to the printer 105 to have the printhead positional adjustment pattern printed out. In this case, examples of a printed result and a verification screen therefor may be the same as those above-described in relation to FIGS. 13 and 14.

Additionally, in step S408, a printhead positional adjustment pattern file is created for a case where color head cartridges are used. In step S409, the file created in step S408 is transmitted to the printer 105 to have the printhead positional adjustment pattern printed out. In this case, examples of a printed result and a verification screen therefor may be the same as those above-described in relation to FIGS. 15 and 16.

Furthermore, in step S411, a printhead positional adjustment pattern file is created for a case where a black head cartridge is used. In step S412, the file created in step S411 is transmitted to the printer 105 to have the printhead positional adjustment pattern printed out. In this case, examples of a printed result and a verification screen therefor may be those corresponding to the black check pattern above-described in relation to FIGS. 13 and 14.

While a description of control processing by a printer driver has been provided for the above first and second embodiments, the present invention is not limited to this arrangement. The present invention may also be applied to, for instance, a printer having such control functions, an information processing apparatus (printing control apparatus, PC), as well as a printing system comprising such an information processing apparatus or a printer.

In the present embodiment, a software program which achieves the functions of the above-described embodiments is directly or remotely supplied to a system or an apparatus. The present invention also includes cases where the functions are achieved by reading out and executing the supplied program codes by a computer of the system or apparatus. In such cases, the program codes need not be in a form of a program, as long as they retain the functions of the program.

Storage devices for supplying the program include, for instance, a floppy disk (registered trademark), a hard disk, an optical disk, a magneto-optical disk, an MO, a CD-ROM, a CD-R, a CD-RW, a magnetic tape, a nonvolatile memory card, a ROM, a DVD (DVD-ROM, DVD-R) or the like.

The present invention is not limited to the above embodiments, and various changes and modification can be made thereto within the spirit and scope of the present invention. Therefore, to apprise the public of the scope of the present invention, the following claims are made.

This application claims priority from Japanese Patent Application No. 2005-200649 filed on Jul. 8, 2005, which is hereby incorporated by reference herein.

What is claimed is:

1. A print control apparatus for supplying a signal to a printer and controlling the printer, wherein the printer is operable to print in a state that all types of ink-jet cartridges that the printer can mount are mounted or in a state that at least one of all the types of ink-jet cartridges is mounted, the apparatus comprising:

a designation unit configured to designate a maintenance operation of the printer;

a determination unit configured to determine whether bidirectional communication with the printer is possible;

an obtaining unit configured to obtain information of attachment/detachment of all the types of ink-jet cartridges and a type of each ink-jet cartridge mounted on the printer, from the printer, in response to a designation by said designation unit, if said determination unit determines that bidirectional communication with the printer is possible;

a selection unit configured to cause a user to select a type of each ink-jet cartridge mounted on the printer among all the types of ink-jet cartridges that the printer can mount, if said determination unit determines that bidirectional communication with the printer is not possible;

a data generation unit configured to generate test data based on the information obtained by said obtaining unit, or information of attachment/detachment of all the types of ink-jet cartridges based on the selection by said selection unit, wherein the test data is used to determine whether it is necessary or not to adjust the printer and to cause the printer to print a test pattern using only the type of each ink-jet cartridge mounted on the printer; and a transmission unit to transmit the test data generated by said data generation unit to the printer.

2. The print control apparatus according to claim 1, further comprising a display control unit configured to compare printed results by the printer with the test data and cause a display unit to display a screen for providing a user with an image with which the user can determine whether it is necessary or not to adjust the printer.

3. The print control apparatus according to claim 1, wherein the test data causes the printer to print a test pattern for at least any one of confirmation of printing status using ink of the ink-jet cartridge and an adjusting operation of printing position using the ink-jet cartridge.

4. The print control apparatus according to claim 3, further comprising storage means for storing a plurality of types of test data for executing at least either confirmation of printing status using the ink of the ink-jet cartridge or an adjusting operation of printing position using the ink-jet cartridge, wherein said data generation unit generates the test data based on test data selected from the plurality of types of test data stored in said storage means.

5. The print control apparatus according to claim 3, wherein said data generation unit generates a nozzle check pattern for detecting presence/absence of ink discharge from each nozzle of the ink-jet cartridge, in a case that the verification of the printing status using the ink of the ink-jet cartridge is designated.

6. The print control apparatus according to claim 3, wherein said data generation unit generates a positional adjustment pattern for performing positional adjustment of the ink-jet cartridge, in a case that a printing positional adjustment operation using ink of the ink-jet cartridge is designated.

7. The print control apparatus according to claim 1, wherein the ink-jet cartridge is a head cartridge in which an ink tank that accommodates ink and a printhead that ejects ink are integrally formed.

8. A print control method of supplying a signal to a printer and controlling the printer, wherein the printer is operable to print in a state that all types of ink-jet cartridges that the printer can mount are mounted or in a state that at least one of all the types of ink-jet cartridges is mounted, the method comprising:

a designation step of designating a maintenance operation of the printer;

a determination step of determining whether bidirectional communication with the printer is possible;

an obtaining step of obtaining information of attachment/detachment of all the types of ink-jet cartridges and a type of each ink-jet cartridge mounted on the printer, from the printer, in response to a designation in said designation step if it is determined in said determination step that bidirectional communication with the printer is possible;

a selection step of causing a user to select a type of each ink-jet cartridge mounted on the printer among all the types of ink-jet cartridges that the printer can mount, if it is determined in said determination step that bidirectional communication with the printer is not possible;

a data generation step of generating test data based on the information obtained in said obtaining step, or information of attachment/detachment of all the types of ink-jet cartridges based on the selection in said selection step, wherein the test data is used to determine whether it is necessary or not to adjust the printer and to cause the printer to print a test pattern using only the type of each ink-jet cartridge mounted on the printer; and a transmission step of transmitting the test data generated in said data generation step to the printer.

9. The print control method according to claim 8, wherein a plurality of types of test data for executing at least either confirmation of printing status using the ink of the ink-jet cartridge or an adjusting operation of printing position are stored in a memory, and in said data generation step, the test data is generated based on the test data selected from the plurality of types of test data stored in the memory.

10. The print control method according to claim 8, wherein in said data generation step, a nozzle check pattern for detecting presence/absence of ink discharge from each nozzle of the ink-jet cartridge is generated, in a case that verification of a printing status using ink of the ink-jet cartridge is designated.

11. The print control method according to claim 8, wherein in said data generation step, a positional adjustment pattern for performing positional adjustment of an ink discharging of the ink-jet cartridge is generated, in a case that printing positional adjustment operations using ink of the ink-jet cartridge is designated.

12. A computer-readable storage medium for storing a printer control program that causes a printer to print, wherein the printer is operable to print in a state that all types of ink-jet cartridges that the printer can mount are mounted or in a state that at least one of all the types of ink-jet cartridges is mounted, the program comprising code for:

a designation step of designating a maintenance operation of the printer;

a determination step of determining whether bidirectional communication with the printer is possible;

an obtaining step of obtaining information of attachment/detachment of all the types of ink-jet cartridges and a type of each ink-jet cartridge mounted on the printer, from the printer, in response to a designation in said designation step, if it is determined in said determination step that bidirectional communication with the printer is possible;

a selection step of causing a user to select a type of each ink-jet cartridge mounted on the printer among all the types of ink-jet cartridges that the printer can mount, if it is determined in said determination step that bidirectional communication with the printer is not possible;

a data generation step of generating test data based on the information obtained in said obtaining step, or information of attachment/detachment of all the types of ink-jet cartridges based on the selection in said selection step, wherein the test data is used to determine whether it is necessary or not to adjust the printer and to cause the printer to print a test pattern using only the type of each ink-jet cartridge mounted on the printer; and a transmission step of transmitting the test data generated in said data generation step to the printer.

13. A printer, wherein the printer is operable to print in a state that all types of ink-jet cartridges that the printer can mount are mounted or in a state that at least one of all the types of ink-jet cartridges is mounted, the printer comprising:

a determination unit configured to determine whether it is possible to obtain information of each ink-jet cartridge mounted on the printer;

an obtaining unit configured to obtain information of attachment/detachment of all the types of ink-jet cartridges and a type of each ink-jet cartridge mounted on the printer, if said determination unit determines that it is possible to obtain the information of each ink-jet cartridge mounted on the printer;

a selection unit configured to cause a user to select a type of each ink-jet cartridge mounted on the printer among all the types of ink-jet cartridges that the printer can mount, if said determination unit determines that it is not possible to obtain the information of each ink-jet cartridge mounted on the printer;

a transmission unit configured to transmit the information obtained by said obtaining unit, or information of each ink-jet cartridge selected by said selection unit, to an information processing apparatus connected to the printer, in response to a designation of maintenance operation by the information processing apparatus;

a reception unit configured to receive test data for printing a test pattern using the ink-jet cartridge mounted on the printer, from the information processing apparatus, wherein the test data is used to determine whether it is necessary or not to adjust the printer; and a print unit configured to print the test pattern using only the type of each ink-jet cartridge, based on the test data received by said reception unit.

* * * * *